US009808821B2

(12) United States Patent
Svidler

(10) Patent No.: US 9,808,821 B2
(45) Date of Patent: Nov. 7, 2017

(54) STABILIZING APPARATUS, METHODS, AND SYSTEMS FOR PUMP DISPENSERS

(71) Applicant: Karen Svidler, San Mateo, CA (US)

(72) Inventor: Karen Svidler, San Mateo, CA (US)

( * ) Notice: Subject to any disclaimer, the term of this patent is extended or adjusted under 35 U.S.C. 154(b) by 0 days.

(21) Appl. No.: 14/502,908

(22) Filed: Sep. 30, 2014

(65) Prior Publication Data

US 2015/0014359 A1 Jan. 15, 2015

(51) Int. Cl.
*B05B 15/06* (2006.01)
*B05B 11/00* (2006.01)

(52) U.S. Cl.
CPC ..... *B05B 15/061* (2013.01); *B05B 11/0037* (2013.01)

(58) Field of Classification Search
CPC ... B05B 15/061; B05B 15/06; B05B 11/0037; B05B 15/063
USPC ..... 222/173, 192, 321.7–321.9, 383.1, 93
See application file for complete search history.

(56) References Cited

U.S. PATENT DOCUMENTS 2,665,824 A * 1/1954 Anderson ..... A47G 19/183 220/293
3,152,245 A * 10/1964 Litman ..... A47J 36/2433 219/405
3,349,967 A * 10/1967 Schneller ..... A47K 5/18 222/130
3,854,633 A * 12/1974 Bouvaist ..... B05B 11/3047 222/183
4,280,638 A * 7/1981 Keihm ..... A47K 5/12 222/180
4,667,856 A * 5/1987 Nelson ..... B67D 1/10 215/280
5,240,147 A * 8/1993 Frazier ..... A47K 5/1205 222/153.01
5,700,991 A * 12/1997 Osbern ..... H05B 3/00 219/214

(Continued)

OTHER PUBLICATIONS

Technical Learning College "Pumping Principles", Continuing Education Professional Development Course, Apr. 1, 2016, 18 pages.

*Primary Examiner* — Nicholas J Weiss
(74) *Attorney, Agent, or Firm* — James F. Hann; Haynes Beffel & Wolfeld LLP

(57) ABSTRACT

Various aspects of the present teachings provide, among other things, stabilizing apparatus, methods, and systems for pump-type dispensers, such as standing, hand-operable, pump-type dispensers. For example, according to various embodiments, a stabilizer for pump-type dispensers can comprise a base that includes one or more sidewalls defining an internal orifice including an open top. A pump-type dispenser can be received in an upright fashion within the orifice of the base, such that a pump at the top of the dispenser extends upward, above the open top, so it is directly accessible for operation by a user. In various embodiments, a majority of the dispenser, but not the entire dispenser, can be received within the orifice of the base. In a variety of embodiments, the base is more resistant to tipping than the dispenser it is configured to hold, alone. In various embodiments, the dispenser comprises a substantially cylindrical, tube-type pump dispenser, which can be, according to some embodiments, disposable after the substance it contains has been depleted (i.e., single-use).

2 Claims, 7 Drawing Sheets

(56) References Cited

U.S. PATENT DOCUMENTS

| | | | | |
|---|---|---|---|---|
| 6,206,600 | B1 * | 3/2001 | Rosenberg | A46B 5/00 401/153 |
| 6,547,104 | B1 * | 4/2003 | Wilkinson | A47K 5/18 222/192 |
| 6,832,702 | B2 * | 12/2004 | Garcia | B05B 11/0037 222/183 |
| D667,698 | S * | 9/2012 | Tupy | D7/619.1 |
| D698,260 | S * | 1/2014 | Phelps | D9/682 |
| 9,237,831 | B1 * | 1/2016 | Luu | A47K 10/16 |
| 2001/0035429 | A1 * | 11/2001 | Colquhoun | A47K 5/12 222/93 |
| 2013/0098941 | A1 * | 4/2013 | Wegelin | B05B 11/0037 222/23 |

* cited by examiner

STABILIZING APPARATUS, METHODS, AND SYSTEMS FOR PUMP DISPENSERS

FIELD

The present teachings relate to pump-type dispensers for nongaseous substances, and to stabilizers, and methods of use, for preventing such dispensers from destabilizing and potentially tipping over.

INTRODUCTION

While great strides have been made over the years in toothpaste technology, practically, little progress has been seen in dispensers for the substance. Two types of dispensers, especially, enjoy widespread use. First, tubes having deformable walls can hold toothpaste. Upon compressing the walls of such tubes to decrease the internal volume, toothpaste can be expelled out of an opening at one end. Cylindrical tubes with rigid walls can hold toothpaste, as well. Typically, an internal plug moves from one end of the tube toward a dispensing end of the tube upon depressing a pump plunger located at the dispensing end. As the internal volume of the tube decreases, toothpaste is expelled out of an opening at the dispensing end. (See, e.g., U.S. Pat. No. 4,437,584; incorporated herein by reference.) Generally, pump-type tube dispensers are considered an improvement over deformable tube dispensers, with regard to a tendency of the toothpaste to build up on the outside of the dispenser, typically at or near the opening. That said, pump-type dispensers are not without disadvantages. For example, when pumping toothpaste, it is not uncommon for the tube to tip over. This can happen, particularly, when holding a toothbrush with one hand and pumping with the other hand, as the standing tube is not particularly stable. Among other mishaps, a tipped tube of toothpaste can roll into other objects, fall off the counter, etc. Tipping is a problem encountered with pump-type tube dispensers for other substances, as well. There is a need to prevent or mitigate undesired tipping of pump-type tube dispensers.

SUMMARY

A non-limiting summary of various embodiments of the present teachings is set forth next.

Various aspects of the present teachings relate to, among other things, stabilizing methods and systems for pump-type dispensers. For example, according to various embodiments, a stabilizing system for pump-type dispensers can comprise a base that includes one or more sidewalls defining an internal orifice including an open top. A pump-type dispenser can be received in an upright fashion within the orifice of the base, such that a pump at the top of the dispenser extends upward past the open top (e.g., into the ambient atmosphere) for unrestricted access to a user.

In a variety of embodiments, the dispenser comprises a substantially cylindrical tube dispenser. In various embodiments, the base and the dispenser each comprise a respective height.

In various embodiments, a majority of the dispenser, but not the entire dispenser, can be received within the orifice of the base. For example, in accordance with various embodiments, greater than 50%, greater than 60%, greater than 70%, greater than 80%, or greater than 90%, of the dispenser can be received within the orifice of the base, while less than 100% of the dispenser is received within the orifice of the base. In a variety of embodiments, the height of the dispenser can be greater than the height of the base, yet a majority of the dispenser is received within the orifice of the base. For example, the dispenser can be up to less than twice the height of the base.

In accordance with various embodiments, the dispenser can contain a nongaseous substance for dispensing. In a variety of embodiments, the substance can comprise a viscous substance. For example, the substance can comprise toothpaste. It should be noted, however, that the dispenser can contain a substance other than toothpaste. For example, according to various embodiments, the dispenser can contain paste, soap, hand sanitizer, lotion, scrub, shampoo, conditioner, etc. In some embodiments, the substance comprises a gel. In a variety of embodiments, the substance comprises an oil. In various embodiments, the substance comprises a cream. According to various embodiments, the substance comprises a butter.

In various embodiments, a dispenser in accordance with the present teachings can be disposable. For example, the dispenser can initially come filled with a desired substance, such as toothpaste. Upon depleting the substance, the dispenser can then be discarded (e.g., recycled). That is, the dispenser can be a single-use item. Once a dispenser has been used and properly discarded, a fresh dispenser filled with the substance can be obtained to replace the empty discarded dispenser in the base.

In a variety of embodiments, the base is more resistant to tipping than the dispenser it is configured to hold, alone. Thus, a tube-type pump dispenser held within the base will be less prone to inadvertent tipping than the same type of dispenser standing by itself. Those skilled in the art will appreciate that a variety of means can be employed to enhance the ability of a base, in accordance with the present teachings, to itself withstand inadvertent tipping. For example, the base can be provided with a relatively low center of gravity. The lower portion (e.g., lower half) of the base can be heavier than the upper portion (e.g., upper half) of the base. The lower portion of the base can have a relatively large footprint, and in various embodiments, a footprint at least 1.1 times larger than that of the dispenser it holds. For example, the footprint of the base can be at least 1.2 times that of the dispenser, at least 1.3 times that of the dispenser, at least 1.4 times that of the dispenser, at least 1.5 times that of the dispenser, at least 1.6 times that of the dispenser, at least 1.7 times that of the dispenser, at least 1.8 times that of the dispenser, at least 1.9 times that of the dispenser, and in a variety of embodiments, the footprint of the base is at least 2 times that of the dispenser it holds. In various embodiments, the footprint of the base is at least 2.5 times, and in some embodiments at least 3 times, that of the dispenser it holds. According to various embodiments, the bottom of the base can be provided with a tacky, sticky, or adhesive material to aid in holding it in place. In some embodiments, a putty can be employed between the bottom surface of the base and the surface upon which it sits. In various embodiments, the base comprises an attachment mechanism on its bottom or side, such as a suction cup, that can hold the base to the surface upon which it sits or to an adjacent surface such as a wall. According to various embodiments, one or more protrusions or extensions can extend from the base that either contact the surface upon which the base sits, enhancing stability, or will contact such surface before the base would tip over.

According to various embodiments, the open top of the base can be configured to receive a tube-type pump dispenser. For example, the open top can comprise an inner diameter that is slightly larger than the outer diameter of the dispenser (measured adjacent the open top, with the dispenser seated in the base). In various embodiments, these dimensions are configured to allow insertion of a dispenser with relative ease, yet to prevent undue wobble or knocking of a dispenser in the base during use. Undue wobble or knocking can, for example, make it difficult to operate the pump of a dispenser and, further, it can destabilize the assembly during use. In various embodiments, these diameters can differ by no more than 6 millimeters (mm), no more than 5 mm, no more than 4 mm, no more than 3 mm, no more than 2.5 mm, no more than 2 mm, no more than 1.5 mm, no more than 1 mm, no more than 0.5 mm, or less.

In accordance with various embodiments, the open top of the base can comprise an inner diameter that is larger, and in some embodiments substantially larger (e.g., greater than 6 mm), than the outer diameter of a tube-type pump dispenser to be received. In some such embodiments, the base can further comprise a ring adapter attached or attachable at the open top of the orifice, wherein the adapter can comprise an inner diameter that is less than an inner diameter at the open top of the orifice. The inner diameter of the ring adapter can be slightly larger than the outer diameter of the dispenser (measured adjacent the ring adapter, with the dispenser seated in the base). For example, in various embodiments, these diameters can differ by no more than 6 millimeters (mm), no more than 5 mm, no more than 4 mm, no more than 3 mm, no more than 2.5 mm, no more than 2 mm, no more than 1.5 mm, no more than 1 mm, no more than 0.5 mm, or less. In various embodiments, the ring adapter is removably attachable. In a variety of embodiments, the inner diameter of the ring adapter (or its effective inner diameter for a cylinder structure to be positioned therein) is adjustable. For example, a threaded passage can extend radially through a wall of the adapter, through which a blunt-ended adjustment screw can be passed. Upon twisting the screw to the right, the effective inner diameter of the adapter can be reduced; and upon twisting the screw to the left, the effective inner diameter of the adapter can be expanded, up to the full inner diameter of the adapter itself. In a variety of embodiments, a set of adapters of varying inner diameters are provided, and a user can select among them depending upon the outer diameter of a pump-type tube dispenser to be used with the base.

In various embodiments, the base further comprises a floor defining a closed bottom for the orifice. The floor can be fixed, movable, or removable. In some embodiments, the base comprises a perforated or sectioned floor defining a partially closed bottom for the orifice.

According to a variety of embodiments, the orifice comprises an open bottom. In various embodiments, the open bottom is configured to receive a pump-type tube dispenser, such that it can pass into the orifice of the base. In accordance with various embodiments, a cover can be adapted to removably attach to the base, over the open bottom. For example, a cover can be mounted for linear reciprocal motion such that it can slide into place over the open bottom, or be pivotally mounted to swing into place over the open bottom, or be adapted to snap or otherwise attach into place over the open bottom, etc.

In various embodiments, the base further comprises a retaining ring attached or attachable at the open top of the orifice, for holding a pump-type tube dispenser in place. This can be useful, among other reasons, to prevent or mitigate undesirable movement of the dispenser within the orifice. In a variety of embodiments, the retaining ring can be removably attachable. For example, the retaining ring can comprise an attachment mechanism selected from the group consisting of a threaded attachment, a snap-fit attachment, a bayonet connection, a keyed insert-and-twist connection, etc. The retaining ring can maintain a tube-type pump dispenser in place in a variety of ways. For example, in various embodiments, a retaining ring according to the present teachings can comprise a fixed inner diameter that is only slightly larger than the outer diameter of a pump-type tube dispenser to be held by it. Upon passing the dispenser through the ring, the outer sidewalls of the dispenser can frictionally engage the inner edges of the ring. In various embodiments, the retaining ring has an inner diameter that can be selectively varied, such that a dispenser can be moved into place within the retaining ring while the inner diameter is relatively large, then the inner diameter of the ring can be reduced (or its effective inner diameter as experienced by the cylindrical tube) so that the ring engages the dispenser.

In a variety of embodiments, a base in accordance with the present teachings comprises inner sidewalls defining a cup-like structure that is configured to receive and hold a pump-type tube dispenser. In some such embodiments, the dispenser sits inside the cup-like structure, while gravity stabilizes the assembly.

In accordance with various embodiments, one or more features of the pump-type tube dispenser can cooperate with the base and assist in placement and retention of the dispenser therein. For example, in various embodiments, a pump-type tube dispenser can have an annular flange formed or affixed at a desired location on its upper exterior, which, e.g., can comprise a diameter greater than the diameter of the top opening of an orifice into which the dispenser is placed. When the flange reaches the top opening, it will not be able to pass into the orifice, but rather it will engage and abut the structure of the base defining the top opening, and the dispenser will sit in place at that point (e.g., stabilizing via gravity), until it is lifted out. In some embodiments, the flange can interlock with the base structure defining the top opening (e.g., via a twist-lock mechanism, threaded fastening mechanism, etc.) after they come into abutment. In various embodiments, one or both abutting surfacing are textured. This can help prevent or mitigate undesired movement of the dispenser when it is used.

According to various embodiments, the base can comprise a non-porous material. In a variety of embodiments, the base comprises a metallic material (e.g., steel), a ceramic material, a plastic material, a stone material, a rubber material, a composite material, or any combination thereof.

In various embodiments, one or more coatings can be applied to the base. For example, in various embodiments, at least the exterior of the base comprises an anti-stick, easy-to-clean protective coating. In some embodiments, at least the exterior of the base comprises a coating that repels water. In a variety of embodiments, at least part of the surface of the base is coated with a material that prevents or mitigates the growth of mold and/or fungus. In a variety of embodiments, the base is coated with one or more paints.

A number of aspects of the present teachings relate to a stabilizer for pump-type tube dispensers. For example, in many embodiments, each such pump-type dispenser includes a top or upper half and a bottom or lower half In various embodiments, for example, a stabilizer can comprise: (i) a base comprising sidewalls defining an internal orifice; (ii) a dispenser comprising a pump at one end, with the dispenser received or receivable within the orifice in an upright orientation such that the pump extends above the open top for direct user access; and, (iii) means for securing the base with respect to the dispenser.

In various embodiments, a majority of the dispenser is received within the orifice; the dispenser contains a nongaseous substance (e.g., a viscous substance, such as toothpaste) for dispensing; and, the base is more resistant to tipping than the dispenser alone.

In accordance with various embodiments, the stabilizer can further comprise means for accommodating pump-type tube dispensers of various diameters in the base.

In a variety of embodiments, the dispenser comprises a substantially cylindrical, tube-type dispenser. In some embodiments, the dispenser is disposable. For example, the dispenser can be a single-use dispenser. In a variety of embodiments, the dispenser is designed to be recycled.

In various embodiments, anti-skid or -slip means are provided on the bottom of the base, e.g., padding or feet (such as one or more rubber pads or feet), or in some embodiments, a tacky or sticky material, such as a putty or adhesive.

According to a variety of embodiments, a base in accordance with the present teachings can include one or more toothbrush, or other implement, holders, e.g., extending downward from its upper surface as one or more narrow, elongate cups and/or as pinchers or annular rings extending from or attached to one or more of its sides.

Further aspects of the present teachings provide various embodiments of a stabilizing system and methods of use. For example, a stabilizing system of the present teachings can comprise: (i) a base comprising sidewalls defining an internal orifice and a narrow, annular top portion including internal and external threads; (ii) a container comprising a narrow, annular top portion including external threads that mate with the internal threads of the base top portion; (iii) a pump assembly comprising an upper pump mechanism and a skirt portion under the pump mechanism, wherein the skirt portion comprises internal threads that mate with the external threads of the base top portion; and, (iv) a narrow cylindrical tube depending from the pump assembly, and extending downward into the container.

In various embodiments, the container comprises a Tetra Pak-type container.

DESCRIPTION OF VARIOUS EMBODIMENTS

Figure 1A:
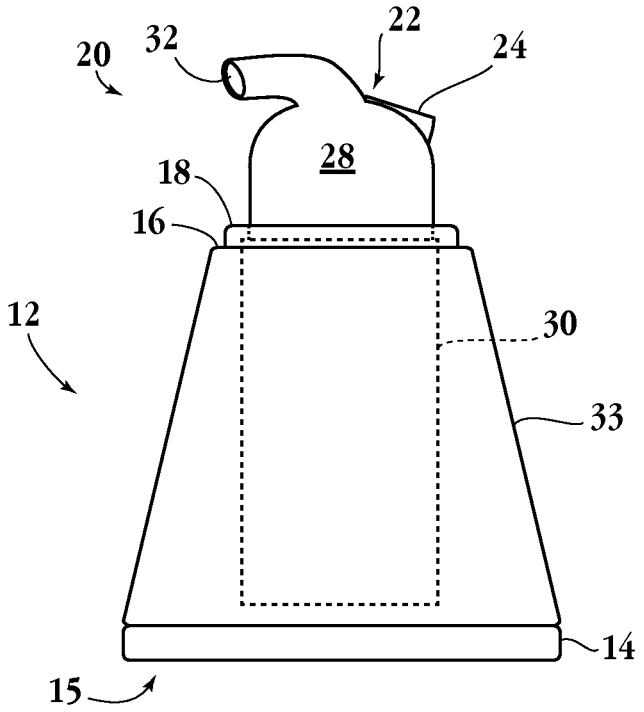
FIG. 1A depicts in schematic form, with portions shown in phantom, a top-loading stabilizing base holding a pump-type tube dispenser with a majority of the dispenser held within the base and a pump head of the dispenser extending above the top of the base for direct hand access by a user, according to various embodiments.

Reference will now be made to various embodiments. While the present teachings will be described in conjunction with various embodiments, it will be understood that they are not intended to limit the present teachings to those embodiments. On the contrary, the present teachings are intended to cover various alternatives, modifications, and equivalents, as will be appreciated by those of skill in the art.

Various aspects of the present teachings relate to, among other things, stabilizing apparatus, methods, and systems for pump-type tube dispensers.

The present teachings can find use, among other ways, in connection with various types of dispensers that expel a substance from their upper region. Among such types of dispensers, in accordance with various embodiments, are pump-type dispensers. Typically, these comprise a mechanical or electro-mechanical pump at their upper region. Upon operation of the pump, an amount of substance contained within the dispenser can be expelled. Some of these pumps are configured for hand operation by a user. For example, a user may operate a pump head (e.g., depress a plunger one or more times) with one or more fingers. Typically, the user will receive a substance from the dispenser with their other hand, or an implement held by that hand (e.g., a toothbrush), while dispensing.

A pump can be employed with a suitable container for holding a desired substance. In accordance with various embodiments, a container can comprise any suitable configuration. Among the various containers, tubes are common. Tubes can hold various substances, such as those typically used by consumers at home. In accordance with various embodiments, a tube comprising a pump can contain, for example, a nongaseous substance. In a variety of embodiments, the substance can comprise a viscous substance, such as toothpaste. Other substances contemplated by various embodiments herein include, for example, soap, hand sanitizer, lotion, scrub, shampoo, conditioner, sun-creams, hair pomades, and pharmaceutical creams, and the like. Such substances can take a variety of forms. For example, in accordance with various embodiments, the substance can comprise a gel, an oil, a cream, a butter, a paste, and the like.

A non-limiting example of a pump-type tube dispenser suitable for use therein is disclosed, for example, in U.S. Pat. No. 6,047,862; incorporated herein by reference. Briefly, a cylindrical tube can contain a viscous substance, such as toothpaste. At the upper region of the tube, a mechanical pump mechanism provides a means for expelling the substance from an outlet, as desired. Another example of a pump-type tube dispenser is disclosed in U.S. Pat. No. 4,437,584; incorporated herein by reference. Other pump-type tube dispensers are suitable for use in connection with the present teachings, as well, as will be appreciated by those skilled in the art. For example, in accordance with some embodiments, the pump can be a hand-operated, electro-mechanical pump.

Generally, in accordance with the present teachings, a pump-type tube dispenser can comprise the ability to stand upright on its own, without the aid of the base as taught herein, or other supporting means or stabilizing means. That said, the ability of such dispensers to resist tipping during use without the aid of such means can be problematic. It will be appreciated by those skilled in the art, however, that various embodiments of a base of the present teachings can be useful, as well, with pump-type tube dispensers lacking the ability to stand upright on their own. These are sometimes referred to as pump-type cartridges.

In various embodiments, a dispenser in accordance with the present teachings can be disposable. For example, the dispenser can initially come filled with a desired substance, such as toothpaste. Upon depleting the substance, the dispenser can then be discarded (e.g., recycled). That is, the dispenser can be a single-use item. Once a dispenser has been used and properly discarded, a fresh dispenser filled with the substance can be obtained to replace the empty discarded dispenser in the base. Those skilled in the art will know how to select suitable materials for recyclability.

Figure 1B:
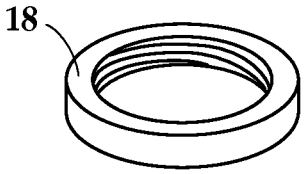
FIG. 1B schematically depicts, in perspective view, an annular ring of the stabilizing base of FIG. 1A, comprising threads on its inner circumference for releasably securing the pump-type tube dispenser to the base.

Referring now to FIG. 1, in accordance with various embodiments, a base is depicted generally by the reference numeral 12. Base 12 is substantially a conical section or frustum of a cone in shape, being wider at its lower region than at its upper region. More specifically, base 12 narrows progressively in a direction from its lower region to its upper region. At the lowermost portion of base, a cover 14 fits over an otherwise open bottom 15. The cover 14 can, for example, snap-fit or otherwise attach onto the bottom 15 of base 12. In various embodiments the cover 14 is detachable to facilitate desired operations, such as cleaning inside the base 12. Once removed, the cover 14 can readily be replaced on the bottom 15 of the base 12. There is a circumferential stepped portion 16 at the upper region of base 12. Radially inward of the stepped portion 16, a raised annular ring 18 defines an upper opening (not visible in FIG. 1) at the uppermost portion of base 12. In the depicted arrangement, a pump-type tube dispenser, indicated generally at 20, is received and seated within the base 12. Particularly, an upper, pump head 22 of such a dispenser is visible in FIG. 1. Pump head 22 includes, for example, a hand-operable push mechanism 24 (e.g., a spring-loaded, depressible button or plunger) for operating the pump. Adjacent the push mechanism 24, a cover 28 that terminates at an outlet 32, through which a substance can be expelled. A lower, tube portion of the dispenser (not shown), which can contain the substance for dispensing, such as toothpaste, depends from the pump portion 22 into an internal orifice (not shown) of the base 12. Internal sidewalls of the base, which in various embodiments can be an internal side of sidewalls 33, can define such orifice. In various embodiments, the dispenser 20 can drop into the base 12 from above. Once the pump head 22 reaches a position immediately above the annular ring 18, the dispenser 12 can attach to the base 12 via any suitable means for securing the base 12 with respect to the dispenser 12. For example, in various embodiments, a circumferential portion of the dispenser immediately below the pump head 22 can include threads (not shown), as well as the internal sidewall of the annular ring 18. These threads (not shown) can be configured to mate for screwing together, thereby spatially fixing the dispenser 20 with respect to the base 12, until such time that the two parts are unscrewed and separated. According to various embodiments, other attachment means can be employed to secure the dispenser 20 with respect to the base 12. For example, and without limitation, suitable attachment mechanisms include snap-fit arrangements, bayonet connections, insert-and-twist connections, etc.

While the depicted embodiment of FIG. 1 shows a substantially conical section or frustum of a cone shape for the base 12, it is noted that the base 12 can take any suitable shape, provided an adequate internal orifice can be provided to receive at least a majority of the dispenser 20. For example, in various embodiments, the base comprises a cylinder, a cube, a cuboid, a frustum, e.g., of a cone or pyramid, a polygon, etc. In various embodiments, the base comprises one or more decorative features, e.g., by way of shape, add-ons, and/or finish.

In the description that follows, with respect to the figures, components that are like or similar to those described previously will share the same reference numerals.

Figure 2:
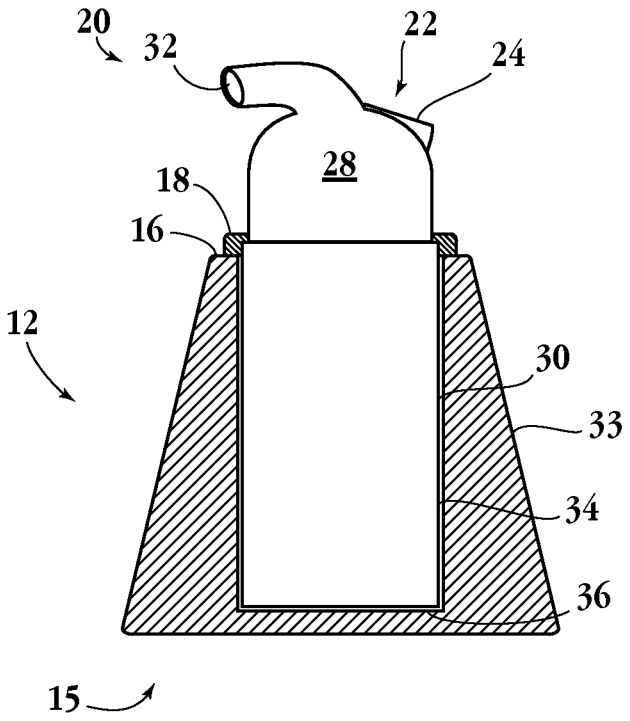
FIG. 2 schematically depicts, in partial cross section, a top-loading stabilizing base comprising an internal cup-shaped orifice receiving a pump-type tube dispenser with a majority of the dispenser held within the base and a pump head of the dispenser extending above the top of the base for direct hand access by a user, according to various embodiments.

Referring now to FIG. 2, an embodiment of a base 12 similar to that shown and described with respect to FIG. 1 is illustrated. The base 12 in FIG. 2, however, includes an internal cup-like structure defined by internal sidewalls 34 and a floor 36. According to various embodiments, a pump-like tube dispenser 20 can drop in from above the base 12, pass through an upper opening defined by an inner radius of an annular ring 18, and sit in the cup-like structure. Once a tube portion 30 of the dispenser 20 becomes seated in the cup-like structure, the pump head portion 22 remains above the annular ring 18 of the base 12 for ready access by a user. Optionally, annular ring portion 18 of base 12 and a corresponding portion of the dispenser 20 can include means for securing the base 12 with respect to the dispenser 12. However, in a variety of embodiments, such means are absent, as the cup-like structure substantially maintains the dispenser 20 in place during use, yet permits ready insertion and removal of the dispenser 20, as desired.

Figure 3:
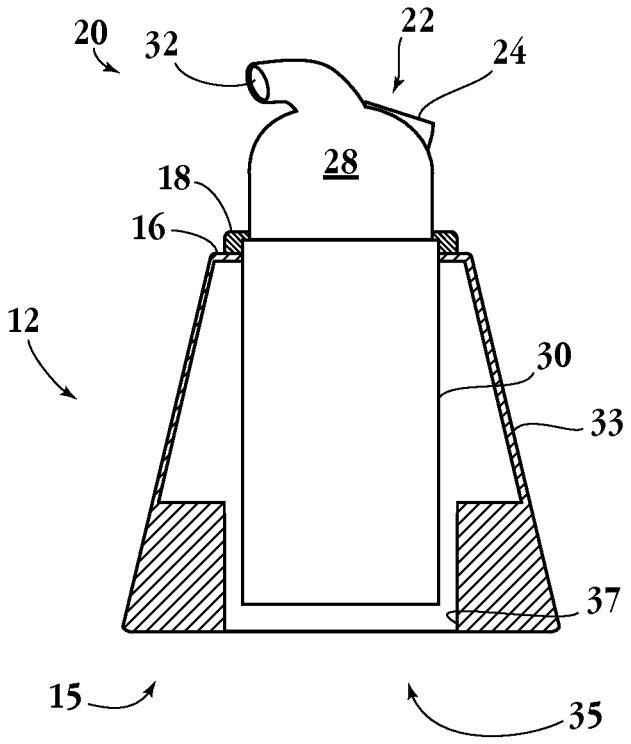
FIG. 3 schematically depicts, in partial cross section, a stabilizing base configured for loading a pump-type tube dispenser from its bottom region, with a pump-type tube dispenser having been loaded therein such that a majority of the dispenser is held within the base and a pump head of the dispenser extends above the top of the base for direct hand access by a user, according to various embodiments.

Referring now to FIG. 3, a bottom-loading base 12 is depicted, in accordance with various embodiments of the present teachings. In the depicted embodiment, a pump-like tube dispenser 20 can be inserted into base 12 by way of a bottom opening 35. Once pump head portion 22 of the dispenser 20 extends through and above the upper opening, with the tube portion 30 housed within the sidewalls 33 of the base 12, the dispenser 20 can be secured in place by means for securing the base 12 with respect to the dispenser 12. For example, the dispenser 20 can be secured in place in the base 12 by a snap-fit arrangement, a bayonet connection, an insert-and-twist connections, or other suitable connector. In the depicted embodiment, mating screw threads of an annular ring 18 and a corresponding portion of the dispenser 20 provide a means for securing the base 12 with respect to the dispenser 12. Means for enhancing the stability of the base 12 are provided. In the depicted embodiment, for example, circumferential region 37 is weighted (i.e., made heavier than it would be otherwise) to make the lower portion of the base heavier than the upper portion.

In some embodiments (not shown), an annular ring screws onto an uppermost portion of a base, thereby expanding a resilient gasket disposed between the bottom of the annular ring and the top of the base. As the gasket expands, its inner portion frictionally engages the outer sidewall of the dispenser, thereby holding it in place. To release the dispenser, the annular ring is simply unscrewed, allowing the gasket to contract to its normal shape.

Figure 4A:
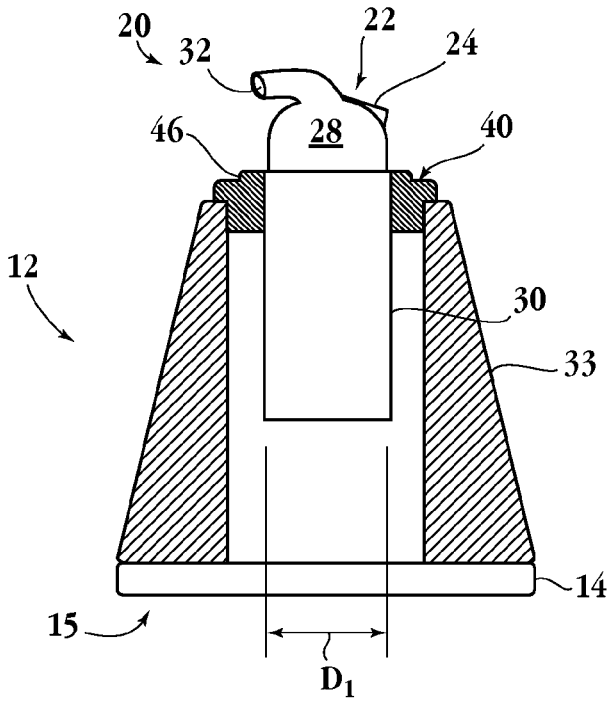
FIGS. 4A and 4B schematically depict, in partial cross-sectional views, a stabilizing base and associated adapter ring, respectively, configured for accommodating pump-type tube dispensers of various diameters in the base, with a majority of a pump-type tube dispenser shown held within the base, having a diameter narrower than that of an internal orifice of the base, and a pump head of the dispenser extending above the top of the base for direct hand access by a user, according to various embodiments.
Figure 4B:
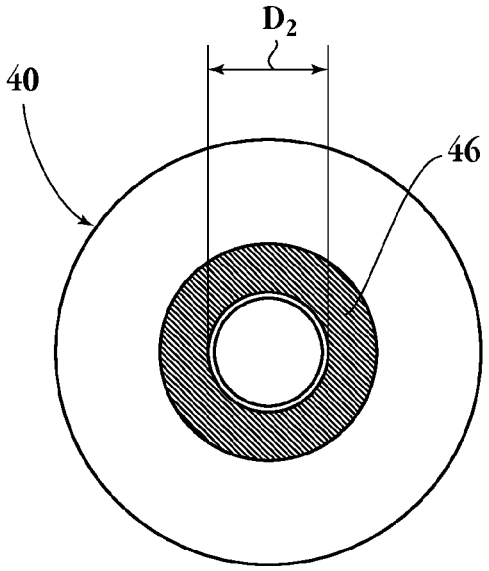

According to various embodiments, means are provided for accommodating pump-type tube dispensers of various diameters in a base. Referring now to FIGS. 4A and 4B, the outer diameter of the lower region of the ringer adapter 40 is substantially similar to the diameter across the inside of the orifice of the base 12. The ring adapter 12 can fit into the upper region of the orifice of the base 12, from the orifice top opening, in the nature of a cork in a bottle. This fit, in various embodiments, is not too tight, however, as it can be desirable to remove the ring adapter 12 and swap it with another comprising a different inner diameter, on occasion.

According to various embodiments, the inner diameter, D2, of the ring adapter 40 can be configured to pass a dispenser 20, comprising an outer diameter D1, with which the base 12 is intended to be used. Once the pump head portion 22 of the dispenser 20 becomes extended above the ring adapter 40, so as to be freely accessible for direct operation by a user, the dispenser 20 can be held in place by means for securing the base 12 with respect to the dispenser 12. In some embodiments, frictional engagement with the inner circumference of the ring adapter 40 can hold the dispenser 20 in place. In various embodiments, the ring adapter 40 comprises a rubber or rubber-like material. The bottom 15 of the base 12 can be open (i.e., comprising no floor), e.g., to facilitate cleaning. A cover 14 can be provided to fit over the open bottom 15, e.g., via a snap fit. In various embodiments, means for enhancing the stability of the base 12 are provided. For example, the cover 14 can be weighted to enhance the stability of the base 12 when the cover 14 is mounted thereon.

In a variety of embodiments, a set of ring adapters of varying inner diameters can be provided, and a user can select among them depending upon the outer diameter of a pump-type tube dispenser to be used with the base. The outer diameter, however, of each ring adapter of the set is substantially the same so as to fit within the recess in the top of the base. The ring adapters can be configured for ready placement and removal in the recess of the base, facilitating exchange, as desired. With continuing reference to FIGS. 4A and 4B, an upper lip 46 of the ring adapter 40 provides a region for a user to grab the ring adapter 40 during placement and removal.

Among other things, the present teachings contemplate that a base, in accordance with various embodiments, can be employed in connection with a variety of commercially available pump-type tube dispensers. For example, various embodiments contemplate use of a GUALA® Pump Dispenser (Guala Dispensing spa; Italy) which can supply a range of viscous creams and gels, such as sun-creams, toothpastes, hair pomades, pharmaceutical creams, etc.

In a variety of embodiments, one or more features of a pump-type tube dispenser can cooperate with a base and assist in placement and retention of the dispenser therein. For example, a base/dispenser system can comprise a dispenser specifically configured for use with a particularly configured base, in accordance with various embodiments of the present teachings. In some embodiments, both the base and dispenser can each comprise at least one feature configured to interact with a feature of the other. For example, in various embodiments, a pump-type tube dispenser can have an annular flange (not shown) formed or affixed and extending outwardly from a desired location on its upper exterior, which, e.g., can comprise a diameter greater than the diameter of the top opening of an orifice into which the dispenser is placed. When the flange reaches the top opening, it will not be able to pass into the orifice, but rather it will engage and abut the structure of the base defining the top opening, and the dispenser will sit in place at that point (e.g., stabilizing via gravity), until it is lifted out. In some embodiments, the flange can interlock with the base structure defining the top opening (e.g., via a twist-lock mechanism, threaded fastening mechanism, etc.) after they come into abutment. In various embodiments, one or both abutting surfacing are textured (not shown). This can help prevent or mitigate undesired movement of the dispenser when it is used.

Figure 5:
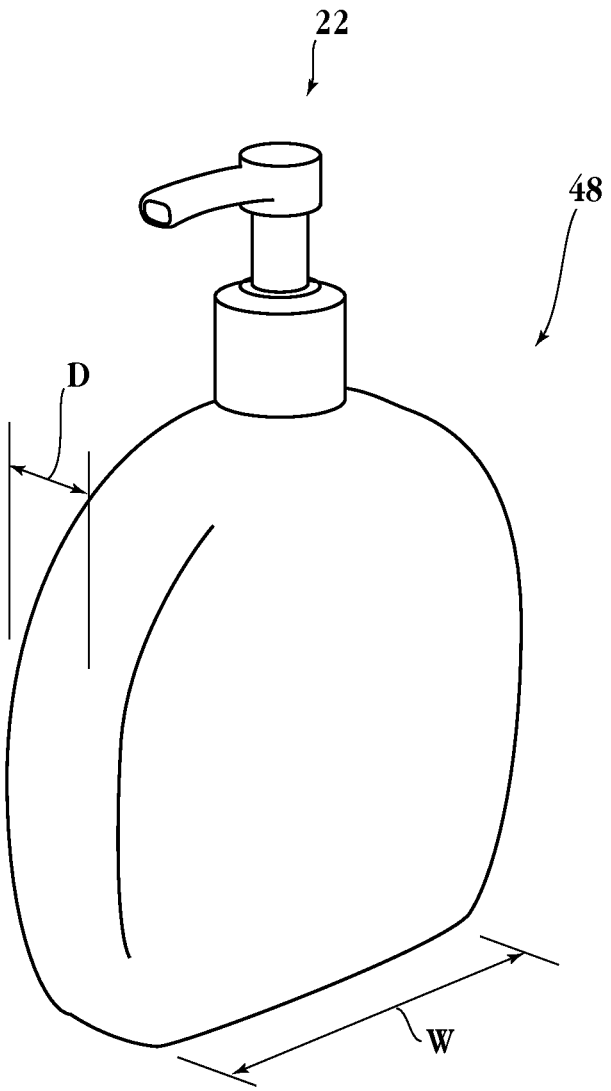
FIG. 5 is a schematic perspective view of a non-cylindrical pump dispenser, comprising a wide dimension and a narrow dimension, for use in connection with a stabilizing base, according to various embodiments.

Those skilled in the art will appreciate that while the present teachings have been described to this point in connection with substantially cylindrical tube-shaped pump dispensers, dispensers of a variety of other shapes are encompassed by the present teachings, as well. For example, as illustrated in FIG. 5, a non-cylindrical pump dispenser 48 comprising a pump head 22 can comprise a wide dimension (side-to-side) or width, W, and a narrow dimension (front-to-back) or depth, D. For example, some of the popular SOFTSOAP® liquid-soap pump dispensers (Colgate-Palmolive Company; New York, N.Y.) can comprise this or a similar shape. It will be appreciated that the narrow dimension can contribute to instability and tipping during operation, especially when pumping with one hand while receiving soap in the other. Some soap dispensers comprise a shape that is narrower towards its lower region than at its upper region. Whatever the shape, among other things, one or both of a disadvantageous center of gravity and a narrow dimension in its footprint with pump dispensers can be destabilizing. Various embodiments of a stabilizing base in accordance with the present teachings can receive and hold such pump dispensers, keeping them steady and stable during pumping. For example, various embodiments can comprise one or more features as described above in connection with stabilizers for substantially cylindrical tube-shaped dispensers. It will be appreciated that various embodiments of a base for such dispensers can comprise sidewalls defining an internal orifice dimensioned to receive the desired dispenser. In some embodiments, the dispenser can be loaded via the bottom of the base, while in a number of embodiments, the base can be configured for top loading.

Figure 6:
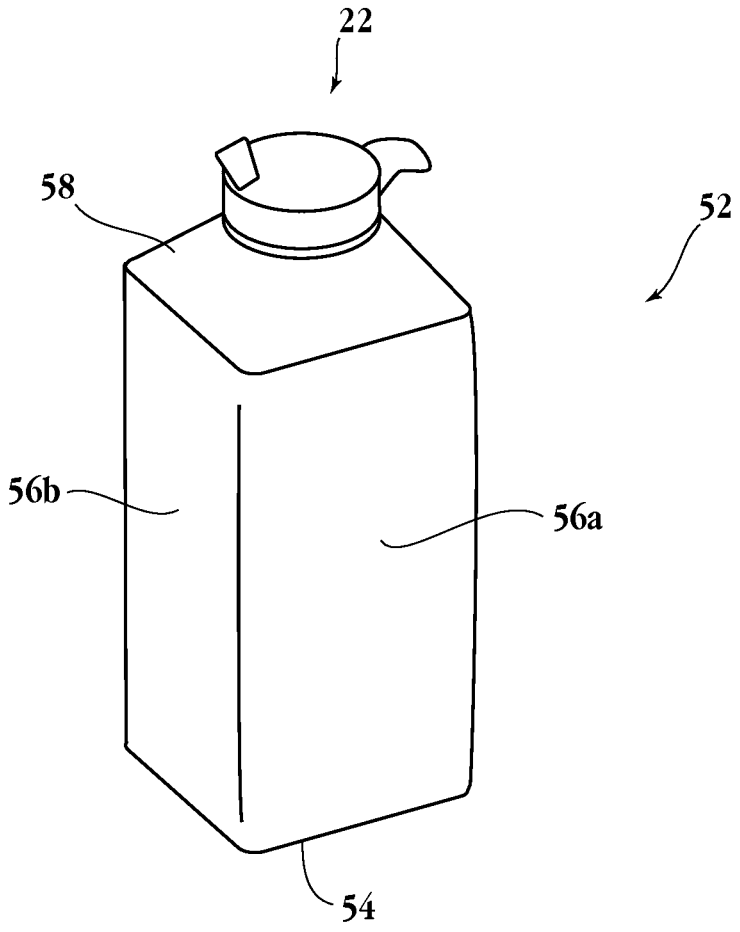
FIG. 6 schematically depicts, in perspective a view, an elongated, four-sided pump dispenser for use in connection with a stabilizing base, according to various embodiments; and, FIG. 7 schematically depicts a stabilizing base configured for receiving a container, such as a Tetra Pak-type container, into an internal orifice of the base via an open bottom of the base, and a container having been so loaded into the orifice of the base, with the container being secured to the base at the top region of the base via external threads at the top of the container that mate with internal threads at the top of the base, as well as a pump mechanism secured to the base at the top of the base via internal threads of a skirt portion of the pump mechanism that mate with external threads at the top of the base, according to various embodiments.

In accordance with various embodiments, an elongated, non-cylindrical pump dispenser contemplated for use herein is illustrated in FIG. 6. The illustrated dispenser 52 comprises a bottom 54, four sidewalls, two of which (56*a*, 56*b*) are visible in FIG. 6, and a top 58 that narrows upward to an annular externally threaded opening that releasably engages a pump head 22. A variety of container types contemplated for use herein include, for example, those sold under the trade name TETRA TOP® (Tetra Pak International S.A.; Pully, Switzerland). Such containers, or containers like or substantially similar to them, can be adapted for use with a hand-operable pump mechanism to comprise a pump dispenser. Various embodiments of a base for such dispensers can comprise sidewalls defining an internal orifice dimensioned to receive the desired dispenser. Various embodiments can comprise one or more features as described above in connection with stabilizers for substantially cylindrical tube-shaped dispensers. In some embodiments, the dispenser is loaded via the bottom of the base, while in a number of embodiments, the base is configured for top loading.

According to various embodiments, a base comprises threads both on the inside and outside at a relatively narrow, annular top portion. A container, such as a Tetra Pak-type container, comprises threads on an outside region of a relatively narrow, annular top portion that can mate with the inside threads of the base top portion. In this way, the container can be inserted into the base, e.g., from the bottom, and screwed into the base; analogous, for example, to how a light bulb may be screwed into a porch light fixture from the bottom and screwed in towards the top of the fixture. A pump assembly, such as, for example, can be typically found on liquid hand soap dispenser, comprises threads on an inside of a "skirt" portion, disposed just under the top pump mechanism, which internal threads can mate with the external threads of the top portion of the base, so that the soap-type pump assembly can be screwed onto the top of the base from above. A depending relatively narrow cylindrical tube of the soap-type pump assembly can then extend downward into the container (when the container is in place), reaching to or near the bottom of the container, or into a lower region of the empty base (when there is no container in the base).

Figure 7:
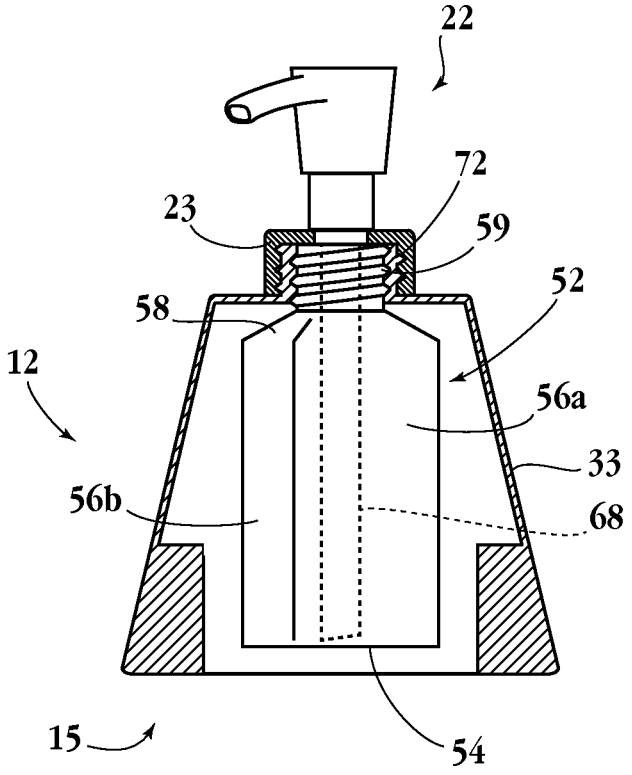

An exemplary non-limiting embodiment, in accordance with the description provided immediately above, is schematically depicted in FIG. 7. For example, a base 12 comprises a relatively wide and open bottom 15 and sidewalls 33 defining an internal orifice configured for receiving a container 52, such as a Tetra Pak-type container. The container 52 comprises a bottom 54, four sidewalls, two of which (56*a*, 56*b*) are visible in FIG. 7, and a top region 58 that narrows upward to an annular, upwardly extending, externally threaded, open top 59. A pump assembly 22 comprises internal threads on a "skirt" portion 23, which "skirt" portion 23 is disposed just under the upper hand-operated (e.g., spring-loaded depressible) portion of the pump mechanism 22. Such internal threads of the "skirt" portion 23 can mate with the external threads of the top 59 of the base 12, so that the pump assembly 22 can be screwed onto the top 59 of the base 12 from above. A depending, relatively narrow, cylindrical tube 68 of the pump assembly 22 can then extend downward inside the container 52, when the container 52 is disposed inside the base 12, reaching to or near the bottom 54 of the container 52; or, into a lower region of the empty base 12, when there is no container disposed in the base 12 (e.g., when the base is empty).

All references set forth herein are expressly incorporated by reference in their entireties for all purposes.

Those skilled in the art can now appreciate from the foregoing description that the broad teachings herein can be implemented in a variety of forms. Therefore, while the present teachings have been described in connection with various embodiments and examples, the scope of the present teachings are not intended, and should not be construed to be, limited thereby. Various changes and modifications can be made without departing from the scope of the present teachings.

It is claimed:

1. A stabilizing and dispensing system, comprising:

a free-standing base comprising sidewalls defining an internal orifice and an open top;

a dispenser comprising a pump at one end for dispensing a substantially constant volume per each cycle of operation, said dispenser received within said orifice in an upright direction such that said pump extends above the open top for direct user access; and, a plurality of ring adapters, each comprising an inner diameter and an outer diameter; wherein said inside of said orifice comprises an inner diameter; wherein said outer diameter of said ring adapter is substantially the same as said inner diameter of said orifice; wherein said inner diameter of said ring adapter is configured to pass a selected dispenser; and further wherein said plurality of ring adapters comprises a plurality of different inner diameters for accommodating a plurality of dispensers of different horizontal cross sections;

wherein a majority of said dispenser is received within said orifice;

wherein said dispenser contains a nongaseous substance for dispensing; and, wherein said base is more resistant to tipping than said dispenser alone.

2. A stabilizing and dispensing system, comprising:

a base comprising a top region and a bottom, and sidewalls extending from said top region to said bottom, wherein said sidewalls define an internal orifice and a narrow, annular top portion in open communication with said internal orifice, wherein said narrow, annular top portion includes internal threads and external threads disposed in opposing relation with respect to one another, and further wherein said bottom is open or openable for receiving a container into said orifice;

a container comprising a narrow, annular top portion including external threads that mate with the internal threads of the annular top portion of the base;

a pump assembly comprising an upper pump mechanism and a skirt portion under the pump mechanism, wherein said skirt portion comprises internal threads that mate with the external threads of the annular top portion of the base; and, a narrow cylindrical tube depending from the pump assembly, and extending downward into the container.

* * * * *